US006443441B1

(12) United States Patent
Buitenhuis

(10) Patent No.: US 6,443,441 B1
(45) Date of Patent: Sep. 3, 2002

(54) BOARD HOLDER ASSEMBLY

(76) Inventor: Richard Buitenhuis, 14936 Riverside Trail, Grand Haven, MI (US) 49417

( * ) Notice: Subject to any disclaimer, the term of this patent is extended or adjusted under 35 U.S.C. 154(b) by 0 days.

(21) Appl. No.: 09/782,858

(22) Filed: Feb. 14, 2001

(51) Int. Cl.[7] ..... B25B 1/20
(52) U.S. Cl. ..... 269/41; 269/905; 269/257
(58) Field of Search ..... 269/41, 905, 43, 269/152–155, 904, 257

(56) References Cited

U.S. PATENT DOCUMENTS

| | | | | |
|---|---|---|---|---|
| 3,963,230 A | | 6/1976 | Jankowski, Jr. | |
| 4,270,741 A | * | 6/1981 | Husrt | 269/905 |
| 4,749,176 A | * | 6/1988 | Bradshaw | 269/41 |
| D310,894 S | * | 9/1990 | Smith | D34/23 |
| 4,997,172 A | | 3/1991 | Mumm et al. | |
| 5,288,090 A | * | 2/1994 | Bross | 269/905 |
| 5,673,903 A | | 10/1997 | Lewis | |
| 5,746,421 A | | 5/1998 | Bowerman | |

* cited by examiner

*Primary Examiner*—Joseph J. Hail, III
*Assistant Examiner*—Lee Wilson
(74) *Attorney, Agent, or Firm*—King & Jovanovic, PLC

(57) ABSTRACT

A board holder assembly comprising: a base member, wherein the base member is configured for engaging a surface of a board; at least one lip member, wherein the at least one lip member emanates contiguously from the base member, and wherein the at least one lip member is configured for placement upon a support member of a structure; a first side wall and a second side wall emanating contiguously from the base member to form a substantially U-shaped channel for receiving the board therein; and a clamp associated with at least one of the first and second side walls to releasably secure the board in the substantially U-shaped channel.

20 Claims, 4 Drawing Sheets

BOARD HOLDER ASSEMBLY

BACKGROUND OF THE INVENTION

1. Field of the Invention

The present invention relates in general to a board holder assembly, and more particularly, to a board holder assembly which is configured to support and align a board, such as a joist and/or a rafter, in a generally perpendicular orientation relative to a support member, such as a ledger board and/or a ridge board of a structure, such as a deck and/or a roof frame. The board holder assembly may also be used to support and align a stud when toe-nailing the same to a sole plate.

2. Background Art

Board holder and/or alignment devices have been known in the art for years and have been the subject of numerous United States Patents, including: U.S. Pat. No. 5,746,421 entitled "BOARD HOLDING DEVICE;" U.S. Pat. No. 5,673,903 entitled "APPARATUS FOR TEMPORARILY SUPPORTING ONE END OF A CROSS PIECE DURING THE CONSTRUCTION OF A DECK OR FENCE RAIL;" U.S. Pat. No. 4,997,172 entitled "JOIST POSITIONING TOOL;" and U.S. Pat. No. 3,963,230 entitled "STUD AND BEAM CLAMP."

U.S. Pat. No. 5,746,421 discloses a metal board holder used in the construction industry having base and body plate members. Each member has a board receiving U-shaped bracket with nail receiving holes. A base plate adjustment slot can receive one or more threaded body plate member extensions which ride in it to permit plate member adjustments with respect to each other. The body plate member is pivotally mounted to its bracket and has several hinged plate sections, the lowermost of which mounts the threaded extension. Locking nuts engage the threaded extension when it is inserted into the base plate's slot to fix the plate with respect to each other.

U.S. Pat. No. 5,673,903 discloses an apparatus which is used to temporarily support one end of a cross piece during construction of a deck or fence rail. The apparatus is in the form of a C-shaped frame having an elongated base plate and a pair of leg plates extending from each end of the base plate. An adjustable clamp member is attached to one of the legs for securing the apparatus to a first vertical beam. A platform is attached to the other leg and receives one end of the cross piece for holding that end of the cross piece in position on one beam while the other end is secured to a second adjacent spaced apart beam. Once a cross piece has been attached to the two adjacent beams, the clamp may be flipped over and the other side of the clamp may be attached to the second beam so that another cross piece may be abutted against the first cross piece and attached between the second beam and a third beam.

U.S. Pat. No. 4,997,172 discloses a tool for positioning and engaging a joist in relationship to a predetermined orientation relative to a cross joint utilized in construction to arrange and orient the first joist in a vertical orientation. The tool comprises a bifurcated head including an internally threaded boss at a rear terminal end thereof to threadedly receive a handle thereon to permit selective replacement of the head to accommodate various width joists. Legs of the head include planar parallel confronting faces and rearwardly tapered side surfaces to effect clearance and enhance visualization in use of the tool. A modification of the invention includes a cross shaft mounted to a rear terminal end of the handle, including spirit level and a series of notches mounted on a top surface of the cross shaft. The notches are cooperative with a spool supporting a plumb level, wherein the series of notches accommodate various head widths of the tool as the plumb level is directed in a spaced adjacent relationship relative to the tool.

U.S. Pat. No. 3,963,230 discloses a clamp assembly comprising a pair of cooperating L-shaped clamp jaws, interconnected by a draw screw. The jaws are adjustable 360 degrees about each other and are invertable. A shock absorbing block of elastomer material is interposed between the clamp members and compressed thereby against the beams being clamped to securely hold them in a selected position and providing a shock transmitting means resisting displacement of the beams during nailing.

While the above-identified devices do appear to hold and/or align a board member, their configurations remain non-desirous and/or problematic inasmuch as none of the above-identified devices enable a user to quickly and safely secure, and, in turn, hold a board, such as a joist and/or rafter, for subsequent alignment.

It is therefore an object of the present invention, to provide a board holder device which, among other things, remedies the aforementioned detriments and/or complications associated with the use of conventional board holder and/or alignment devices.

SUMMARY OF THE INVENTION

The present invention is directed to a board holder assembly comprising: (a) a base member, wherein the base member is configured for engaging a surface of a board; (b) at least one lip member, wherein the at least one lip member emanates contiguously from the base member, and wherein the at least one lip member is configured for placement upon a support member of a structure; (c) a first side wall and a second side wall emanating contiguously from the base member to form a substantially U-shaped channel for receiving the board therein; and (d) a clamp, such as a lever clamp, associated with at least one of the first and second side walls for releasably securing the board in the substantially U-shaped channel.

In a preferred embodiment of the invention, the at least one lip member includes two lip members which emanate contiguously from opposite ends of the base member.

In another preferred embodiment of the invention, the first side wall includes a plurality of board engaging tabs which facilitate securement of the board.

In yet another preferred embodiment of the invention, the first side wall includes a plurality of board engaging tabs which facilitate securement of the board, and the second side wall includes a clamp for releasably securing the board in the substantially U-shaped channel.

In another aspect of the present invention, the first side wall and the second side wall each include a clamp.

Preferably, the first side wall and the second side wall each comprise a trapezoidal cross-section which enables a board hanger to be secured to the board and the support member of the structure while the board is positioned in the substantially U-shaped channel.

In a preferred embodiment of the invention, the first side wall and the second side wall each include an edge emanating at approximately 45 degrees from the base member to a top surface of their respective side walls which enable a board hanger to be secured to the board and the support member of the structure while the board is positioned in the substantially U-shaped channel.

Preferably, the board holder assembly includes components fabricated from a material selected from the group consisting of steel, aluminum, metallic alloys, natural or synthetic plastics, and mixtures thereof.

The present invention is also directed to a board holder device comprising: (a) a base member, wherein the base member is configured for engaging a surface of a board; (b) a pair of lip members, wherein the lip members emanate contiguously from the base member, and wherein the lip members are configured for placement upon a support member of a structure; and (c) a first side wall and a second side wall emanating contiguously from the base member to form a substantially U-shaped channel for receiving the board therein, wherein the first side wall includes a plurality of board engaging tabs, and the second side wall includes a lever clamp, which together cooperatively facilitate securement of the board within the substantially U-shaped channel.

The present invention is further directed to a board holder assembly consisting of: (a) a base member, wherein the base member engages a surface of a board; (b) at least one lip member, wherein the at least one lip member emanates contiguously from the base member, and wherein the at least one lip member is placed upon a support member, such as a ledger board or a ridge board, of a structure, such as a deck or a roof frame; (c) a first side wall and a second side wall emanating contiguously from the base member to form a substantially U-shaped channel having a board retained therein; and (d) a lever clamp associated with at least one of the first and second side walls, which is releasably secured to the board retained in the substantially U-shaped channel.

BRIEF DESCRIPTION OF THE DRAWINGS

The invention will now be described with reference to the drawings wherein.

DETAILED DESCRIPTION OF THE INVENTION

Figure 1:
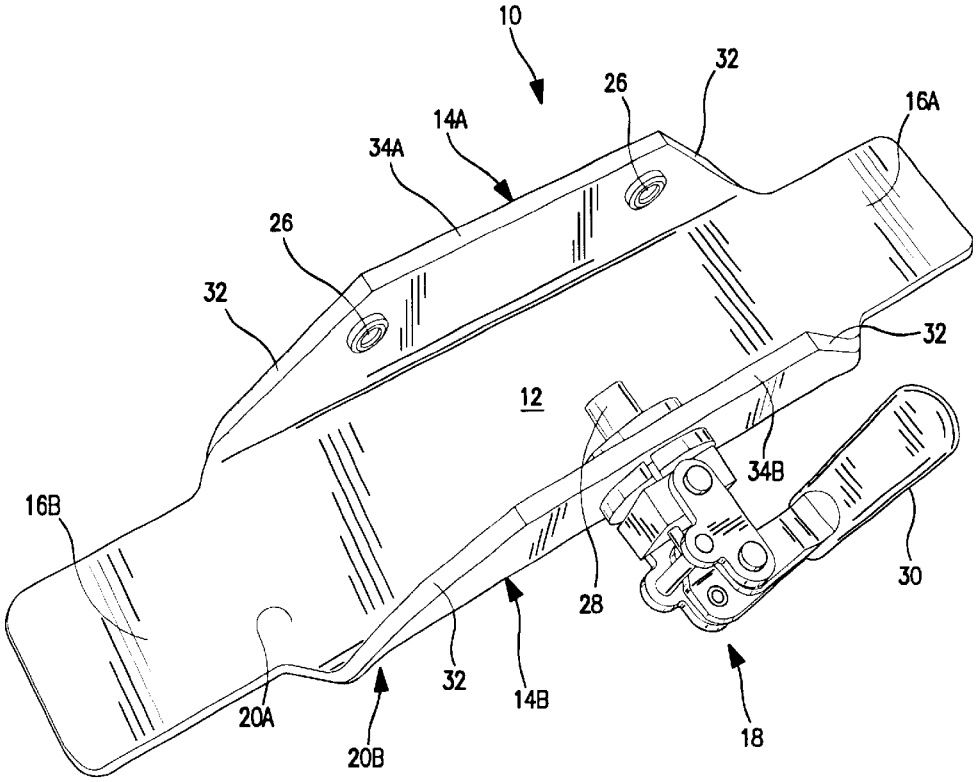
FIG. 1 of the drawings is a perspective representation of an embodiment of a board holder assembly fabricated in accordance with the present invention, showing the clamp in an engaged position.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings and to FIG. 1 in particular, board holder assembly 10 is shown, which generally comprises base member 12, first side wall 14A, second side wall 14B, first lip member 16A, second lip member 16B and clamp 18. It will be understood that FIG. 1 is merely a perspective representation of board holder assembly 10. As such, some of the components may be distorted from their actual scale for pictorial clarity. As will be explained in greater detail below, board holder assembly 10 provides a builder with a tool which enables the builder to quickly and safely secure one end of a board, such as a joist and/or a rafter onto a support member, such as a ledger board and/or a ridge board. By securing one end of the board onto the support member, a single individual can, among other things, align, mount, and secure the unsupported end of the board without additional personnel, as well as mount and secure a board hanger to the support end of the board and a support member while the board is retained within the board holder assembly. Such a board holder assembly enables an individual to quickly and safely build structures, such as decks and/or roof frames without the assistance of additional personnel.

Figure 2:
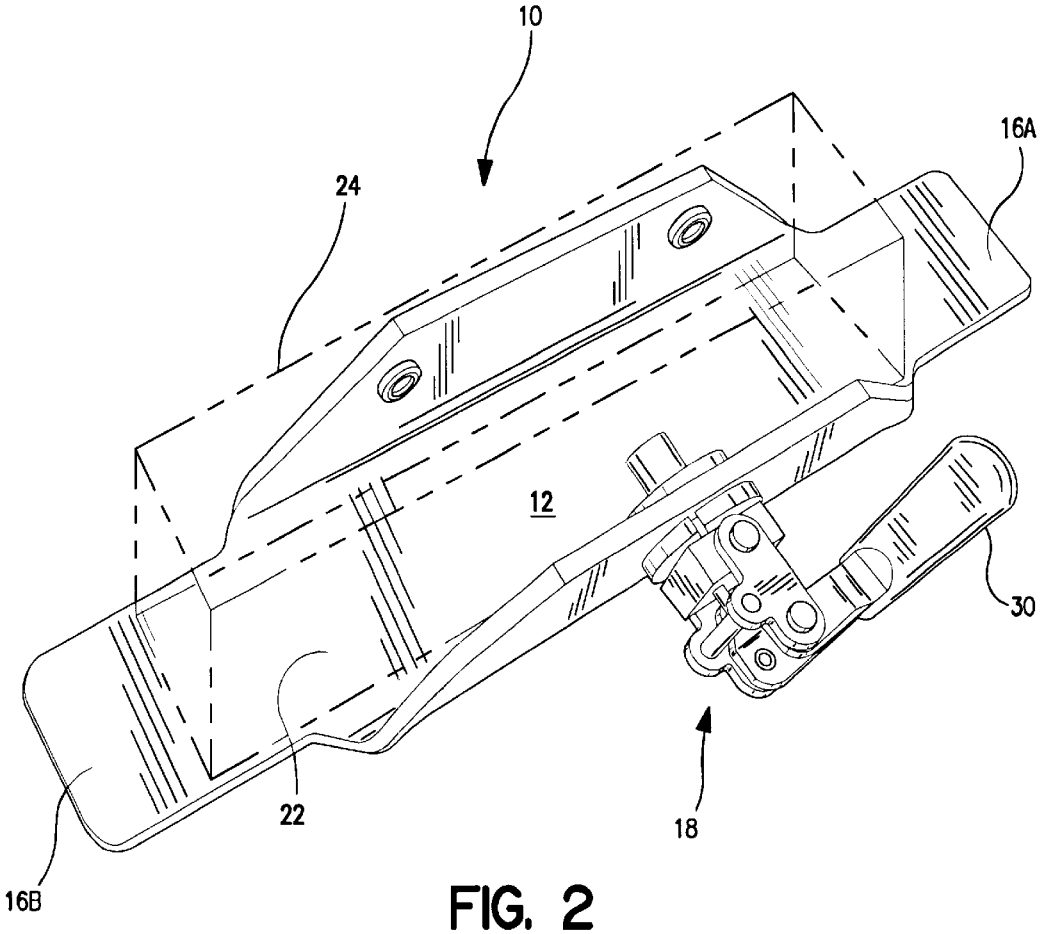
FIG. 2 of the drawings is a perspective representation of an embodiment of a board holder assembly fabricated in accordance with the present invention associated with a transparently represented board.

Base member 12 is generally rectangular in shape, and includes inner surface 20A and outer surface 20B. As is best shown in FIG. 2, base member 12 is configured for engaging surface 22 of board 24—which is shown in transparent form.

Referring back again to FIG. 1, lip members 16A and 16B emanate contiguously from base member 12 at opposite ends thereof, and are configured for placement upon a support member (e.g. a ledger board, a ridge board) of a structure (e.g. a deck, a roof frame). While board holder assembly 10 has been disclosed as comprising two lip members, it will be understood that board holder assembly 10 may include a single lip member which can be placed upon a support member. It will be further understood that while lip members 16A and 16B have been disclosed as comprising generally smooth surfaces, non-smooth surfaces may also be used to increase friction between the support member and the lip member(s).

First and second side walls 14A and 14B, respectively, emanate contiguously in a generally upward vector from surface 20A of base member 12 to form a substantially U-shaped channel for receiving a board therein. First side wall 14A includes two board engaging tabs 26, which facilitate securement of the board in the U-shaped channel. It will be understood that while first side wall 14A includes two board engaging tabs, any one of a number of board engaging tabs may be associated with the first and/or second side walls.

Figure 3:
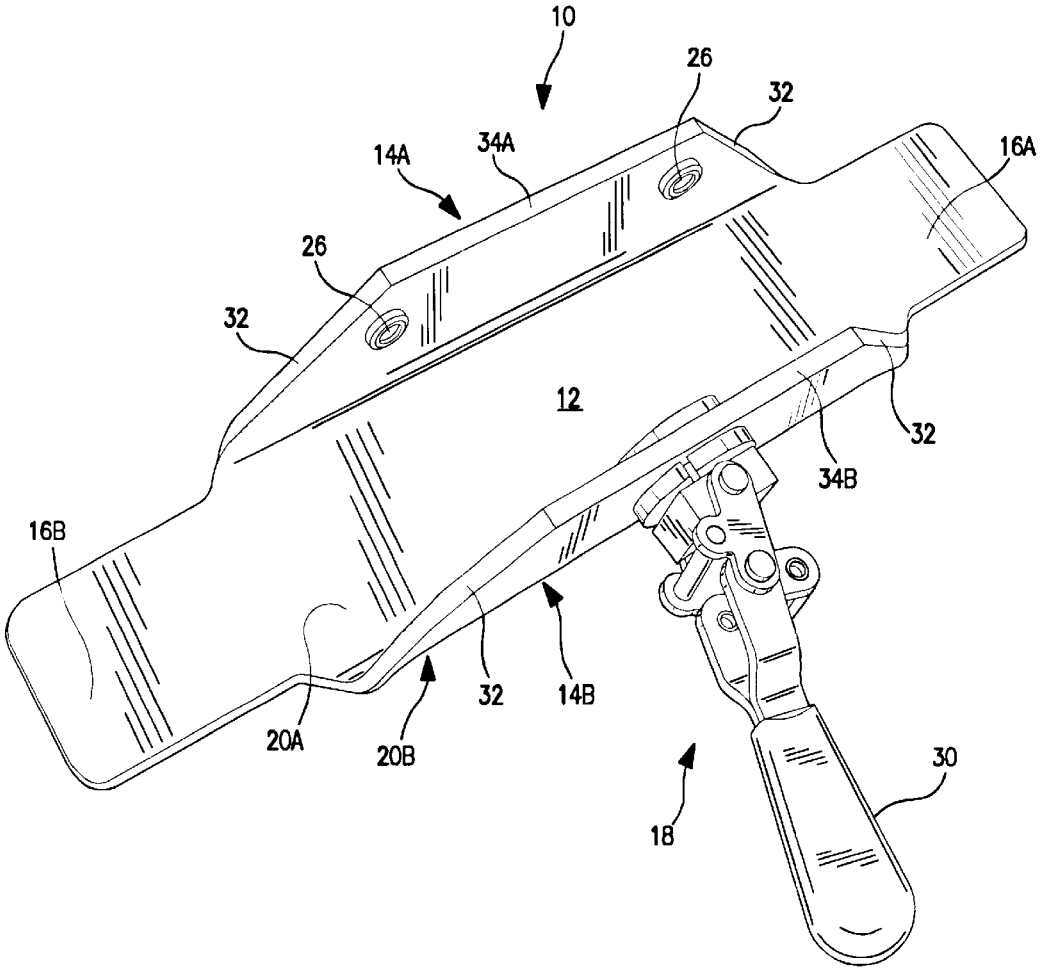
FIG. 3 of the drawings is a perspective representation of an embodiment of a board holder assembly fabricated in accordance with the present invention, showing the clamp in a disengaged position.
Figure 4:
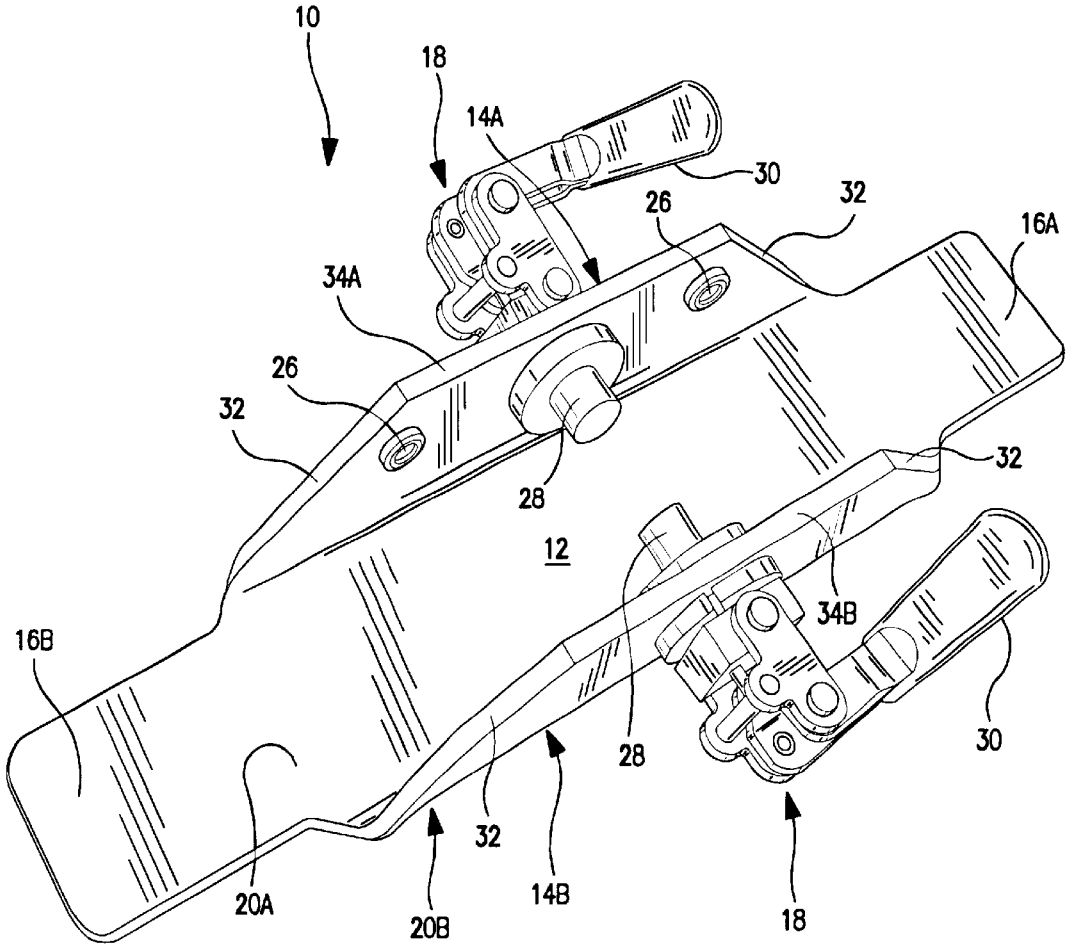
FIG. 4 of the drawings is a perspective representation of an embodiment of a board holder assembly fabricated in accordance with the present invention, showing a plurality of clamps in an engaged position.

Second side wall 14B includes clamp 18, which, in cooperation with tabs 26, releasably secures a board in the substantially U-shaped channel defined by base member 12, first side wall 14A, and second side wall 14B. For purposes of the present disclosure, clamp 18 includes board engaging piston 28, which is actuated from an engaged position (See FIG. 1) to a disengaged position (See FIG. 3) upon radial displacement of lever 30. As can be seen clamp 18, provides for a fast, safe, and reliable mechanism to secure a board within the above-identified substantially U-shaped channel. Clamp 18 is commercially available from, among others, Carr Lane, DE.STA.CO. While clamp 18 has been shown, for illustrative purposes only, as comprising a lever clamp or push-pull clamp, it will be understood that numerous other clamping mechanisms that would be known to those with ordinary skill in the art having the present disclosure before them are likewise contemplated for use. Examples of other clamps or clamping mechanisms, include, for example, cam driven clamps, ratcheting clamps—just to name a few.

As is best shown in FIG. 1, first side wall 14A and said second side wall 14B each comprise a generally trapezoidal cross-section. The generally trapezoidal cross-section enables a board hanger, such as a joist hanger, to be secured to a board and a support member, such as a ledger board while the board is positioned in the substantially U-shaped channel. For purposes of the present disclosure, and more particularly, first side wall 14A and second side wall 14B each include edges 32 which emanate upwardly at approximately 45 degrees from base member 12 to top surfaces 34A and 34B, respectively.

In accordance with the present invention, board holder assembly 10 includes a plurality of components which may be fabricated from any one of a number of materials, including steel, aluminum, metallic alloys, natural or synthetic plastics, and mixtures thereof.

In operation, clamp 18 of board holder assembly 10 is placed in the disengaged position by clockwise radial displacement of lever 30. Once in the disengaged position, a board can be placed into the U-shaped channel of board holder assembly 10. Next, clamp 18 of board holder assembly 10 is placed in the engaged position by counterclockwise radial displacement of lever 30. Upon such displacement of lever 30, piston 28 is driven at least partially into the board contained within the U-shaped channel, thereby securely fastening the board within board holder assembly. After the board is properly secured, a lip member, for example, lip member 16A is placed upon a support member, such as a ledger board of a deck. Now a single individual can align, mount, and secure the unsupported end of the board (i.e. the end void of a board holder assembly) without additional personnel. Additionally, an individual can mount and secure a board hanger to the support end of the board and a support member while the board is retained within the board holder assembly. Once the board is properly secured to its surrounding structure, board holder device 10 can be quickly removed, by disengaging clamp 18 upon radial displacement of lever 30 in a clockwise direction.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A board holder assembly, comprising:

a base member, wherein said base member is configured for engaging a surface of a board;

at least one lip member, wherein said at least one lip member emanates contiguously from said base member, and wherein said at least one lip member is configured for placement upon a support member of a structure;

a first side wall and a second side wall emanating contiguously from said base member to form a substantially U-shaped channel for receiving said board therein; and a clamp associated with at least one of said first and second side walls for releasably securing said board in said substantially U-shaped channel, wherein said clamp is capable of effectively holding said board regardless of orientation thereof.

2. The board holder assembly according to claim 1, wherein said at least one lip member includes two lip members which emanate contiguously from opposite ends of said base member.

3. The board holder assembly according to claim 1, wherein said first side wall includes a plurality of board engaging tabs which facilitate securement of said board.

4. The board holder assembly according to claim 1, wherein said first side wall includes a plurality of board engaging tabs which facilitate securement of said board, and said second side wall includes a clamp for releasably securing said board in said substantially U-shaped channel.

5. The board holder assembly according to claim 1, wherein said first side wall and said second side wall each include a clamp.

6. The board holder assembly according to claim 1, wherein said first side wall and said second side wall each comprise a trapezoidal cross-section to enable a board hanger to be secured to said board and said support member of said structure while said board is positioned in said substantially U-shaped channel.

7. The board holder assembly according to claim 1, wherein said first side wall and said second side wall each include an edge emanating at approximately 45 degrees from said base member to a top surface of their respective side walls which enable a board hanger to be secured to said board and said support member of said structure while said board is positioned in said substantially U-shaped channel.

8. The board holder assembly according to claim 1, wherein said clamp consists of a lever clamp.

9. The board holder assembly according to claim 1, wherein said assembly includes components fabricated from a material selected from the group consisting of steel, aluminum, metallic alloys, natural plastics, synthetic plastics, and mixtures thereof.

10. A board holder device, comprising:

a base member, wherein said base member is configured for engaging a surface of a board;

a pair of lip members, wherein said lip members emanate contiguously from said base member, and wherein said lip members are configured for placement upon a support member of a structure; and a first side wall and a second side wall emanating contiguously from said base member to form a substantially U-shaped channel for receiving said board therein, wherein said first side wall includes a plurality of board engaging tabs, and said second side wall includes a lever clamp, which together cooperatively facilitate securement of said board within said substantially U-shaped channel.

11. The board holder device according to claim 10, wherein said lip members include a pair of lip members which emanate contiguously from opposite ends of said base member.

12. The board holder device according to claim 10, wherein said first side wall and said second side wall each include a lever clamp.

13. The board holder device according to claim 10, wherein said first side wall and said second side wall each comprise a trapezoidal cross-section to enable a board hanger to be secured to said board and said support member of said structure while said board is positioned in said substantially U-shaped channel.

14. The board holder device according to claim 10, wherein said first side wall and said second side wall each include an edge emanating at approximately 45 degrees from said base member to a top surface of the respective side wall, which enables a board hanger to be secured to said board and said support member of said structure while said board is positioned in said U-shaped channel.

15. The board holder assembly according to claim 10, wherein said assembly includes components fabricated from a material selected from the group consisting of steel, aluminum, metallic alloys, natural plastics, synthetic plastics, and mixtures thereof.

16. A board holer assembly, consisting of:

a base member, wherein said base member engages a surface of a board;

at least one lip member, wherein said at least one lip member emanates contiguously from said base member, an wherein said at least one lip member is placed upon a support member of a structure;

a first said wall and a second said wall emanating contiguously from said base member to form a substantially U-shape channel having a board therein; and a lever clam associated with at least one of said first and second side walls, which is releasably secured to said board in said substantially U-shaped channel, wherein said clamp is of effectively holding said board regardless of orientation thereof.

17. The board holder assembly according to claim 16, wherein said support member consists of a ledger board of a deck.

18. The board holder assembly according to claim 16, wherein said support member consists of a ridge board of a roof frame.

19. The board holder assembly according to claim 16, wherein said structure consists of a deck.

20. The board holder assembly according to claim 16, wherein said structure consists of a roof frame.

* * * * *